US006354129B1

(12) United States Patent
Venturini

(10) Patent No.: US 6,354,129 B1
(45) Date of Patent: Mar. 12, 2002

(54) BENDING MACHINE FOR SHEET METAL PANELS WITH HIGH EDGES

(75) Inventor: Gianfranco Venturini, Cologna Veneta (IT)

(73) Assignee: Salvagnini Italia S.p.A. (IT)

( * ) Notice: Subject to any disclaimer, the term of this patent is extended or adjusted under 35 U.S.C. 154(b) by 0 days.

(21) Appl. No.: 09/571,048

(22) Filed: May 15, 2000

(30) Foreign Application Priority Data

Jun. 3, 1999 (IT) ..... MI99A1245

(51) Int. Cl.[7] ..... B21D 5/04
(52) U.S. Cl. ..... 72/322; 72/316
(58) Field of Search ..... 72/316, 319, 320, 72/322, 323

(56) References Cited

U.S. PATENT DOCUMENTS 4,441,353 A * 4/1984 Asari ..... 72/316
4,944,176 A * 7/1990 Glorieux ..... 72/319
5,694,801 A * 12/1997 Takahashi ..... 72/319

FOREIGN PATENT DOCUMENTS

EP 0 293 964 12/1988
FR 2642677 * 8/1990 ..... 72/319

* cited by examiner

*Primary Examiner*—Daniel C. Crane
(74) *Attorney, Agent, or Firm*—Akerman Senterfitt

(57) ABSTRACT

Bending machine for sheet metal panels with high edges, comprising a counter blade fixedly mounted to a stationary base, a mobile blank holder placed above the counter blade, a turnable support for blank holder that is hinged to said stationary base, first moving means connected with the turnable support in order to control its rotation with respect to the stationary base, the blank holder being connected with the turnable support in such a way so as to be able to slide upward and downward with respect to it and second moving means are provided that are suitable to control the sliding of the same blank holder with respect to the turnable support.

6 Claims, 3 Drawing Sheets

BENDING MACHINE FOR SHEET METAL PANELS WITH HIGH EDGES

The present invention refers to a bending machine for sheet metal panels with high edges.

There are known bending machines for sheet metal panels in which the sheet metal panel to be bent, arranged horizontally, is initially squeezed between two bodies, a lower one called "counter blade," that is fixedly mounted to the base of the machine and operates as a support for the sheet metal panel, and an upper one called "blank holder", that is mobile between a raised position for the introduction of the sheet metal panel and a lowered position in which its resting foot cooperates with the counter blade in order to hold and to keep the same sheet in position. The sheet metal is positioned in such a way that one of its edges, that is destined to be bent, projects horizontally as regards the edges of the counter blade and of the blank holder. The sheet metal is then bent upward by a lower bending blade or downward by an upper bending blade that is situated above said edge. Said upper and lower blades form a pair of bending blades that are usually fixedly mounted to a common support that is displaceable by independent operation which is combinable in vertical and horizontal direction. A machine of this kind has been described, for instance, in the European patent No. 0293964.

In the aforesaid machine the blank holder is hinged onto the back part of the base and it is driven to rotate by hydraulic cylinders whose rods are hinged to the base, and therefore the trajectory described by the blank holder in its lowering and lifting movements is not really rectilinear but is an arc of circumference. This does not allow the bending of sheet metal panels having very high edges since the impact of the blank holder foot with the folded edge would be inevitable during the lifting of the same blank holder.

In view of the state of the art herein described, object of the present invention is to realise a bending machine that allows to bend sheet metal with high edges while preventing any impact of the blank holder foot with the folded edge of the sheet metal panels.

According to the present invention, such object is attained by means of a bending machine for sheet metal panels with high edges comprising a counter blade that is fixedly mounted to a stationary base, a mobile blank holder placed above the counter blade, a turnable support for blank holder that is hinged to said stationary base, first moving means connected with said turnable support so as to control its rotation with respect to said stationary base, characterized in that said blank holder is connected with said turnable support in such a way so as to be able to slide upward and downward with respect to it and second moving means are provided that are suitable to control the sliding of the same blank holder with respect to said turnable support.

Thanks to the present invention a bending machine for sheet metal panels with high edges has been realised that, besides the usual rotary motion, allows the blank holder a substantially rectilinear vertical sliding motion, thus preventing the impact of the same blank holder with the folded edge of the sheet metal panels.

The characteristics and the advantages of the present invention will become evident from the following detailed description of an embodiment thereof that is illustrated as a non limiting example in the enclosed drawings, in which.

Figure 1:
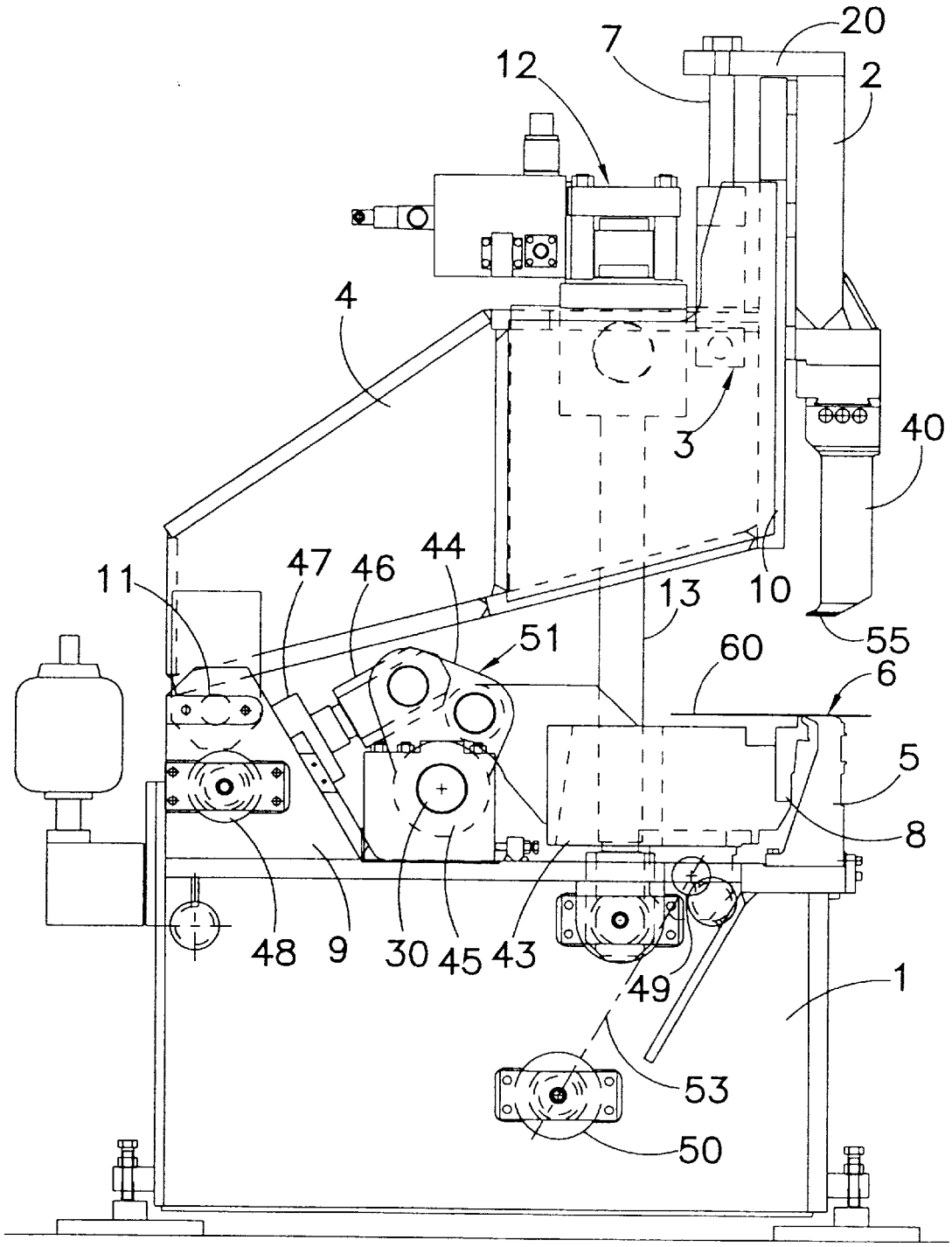
FIG. 1 is a vertical side view of a bending machine according to an embodiment of the present invention.

In the annexed figures a bending machine according to the invention is shown comprising a base 1 to which a counter blade 5 is frontally fixed, that serves as resting support for a sheet metal panel to be bent; a blank holder 40 with a bearing foot 55 is superimposed on the counter blade 5 and is fixed to the lower end of a slidable support 2. Said slidable support 2 is capable to slide vertically on guides 10 and it is fixedly mounted through a perpendicular extension 20 of its upper end to one or more piston rods 7, each belonging to a hydraulic cylinder 3 that is parallel to the same slidable support 2 and housed in a turnable support 4. At the back end of the machine said turnable support 4 is hinged at 11 between two supports 9 that are fixedly mounted to the base 1.

The turnable support 4 is movable owing to a linear sequence of hydraulic cylinders 12 (a single one shown in FIG. 1) whose rods 13 are hinged to the base 1.

Between the base 1 and the support 4 a bending blade 8 with relative blade holder 43 and a unit 51 for its moving are housed. The blade holder 43 is vertically crossed by the rods 13 of the cylinders 12 and at the end opposite to the blade 8 it is hinged to a crank 44 that is hinged at 30 to a support 45 that is fixedly mounted to the base 1; this crank 44 is in turn hinged to a rod 46 of a hydraulic cylinder 47 that is fixedly mounted to the supports 9. The support 43 for the bending blade 8 is provided with a bottom flange 49 that is hinged to a rod of an additional hydraulic cylinder, rendered only by its axis 53 in the figures, that is fixed to the base 1 at a point 50.

The hydraulic cylinders 12 cause a movement of the blank holder 40 according to a circumference arc trajectory, since the support 4 rotates around a horizontal axis passing through the hinge points 11 of the same support 4 with the support 9 fixedly mounted to the base 1. More precisely the extension of the rods 13 causes the lifting of the blank holder 40, while their reversal causes the lowering of the blank holder 40 onto the sheet metal panel 6, so as to keep the latter in position on the counter blade 5 during its bending.

The bending blade 8 is mobile both in horizontal sense and in vertical sense owing to the moving unit 51; the extension or the retraction of the rod 46 of the hydraulic cylinder 47 causes the rotation of the crank 44, which causes the forward or back movement of the blade holder 43 and therefore of the blade 8. The hydraulic cylinder 53 instead causes a motion of rotation of the same blade holder 43 around the horizontal rotation axis passing through the hinge point 30 of the crank 44, motion that translates into a substantially vertical movement of the bending blade 8.

The hydraulic cylinder 3 instead causes the rectilinear vertical movement of the blank holder 40 as regards the counter blade 5. In fact the extension or the retraction of the rod 7 of the hydraulic cylinder 3 respectively allows the lifting or the lowering of the slidable support 2 to which the blank holder 40 is fixedly mounted and that is capable to slide through the guides 10.

Figure 2:
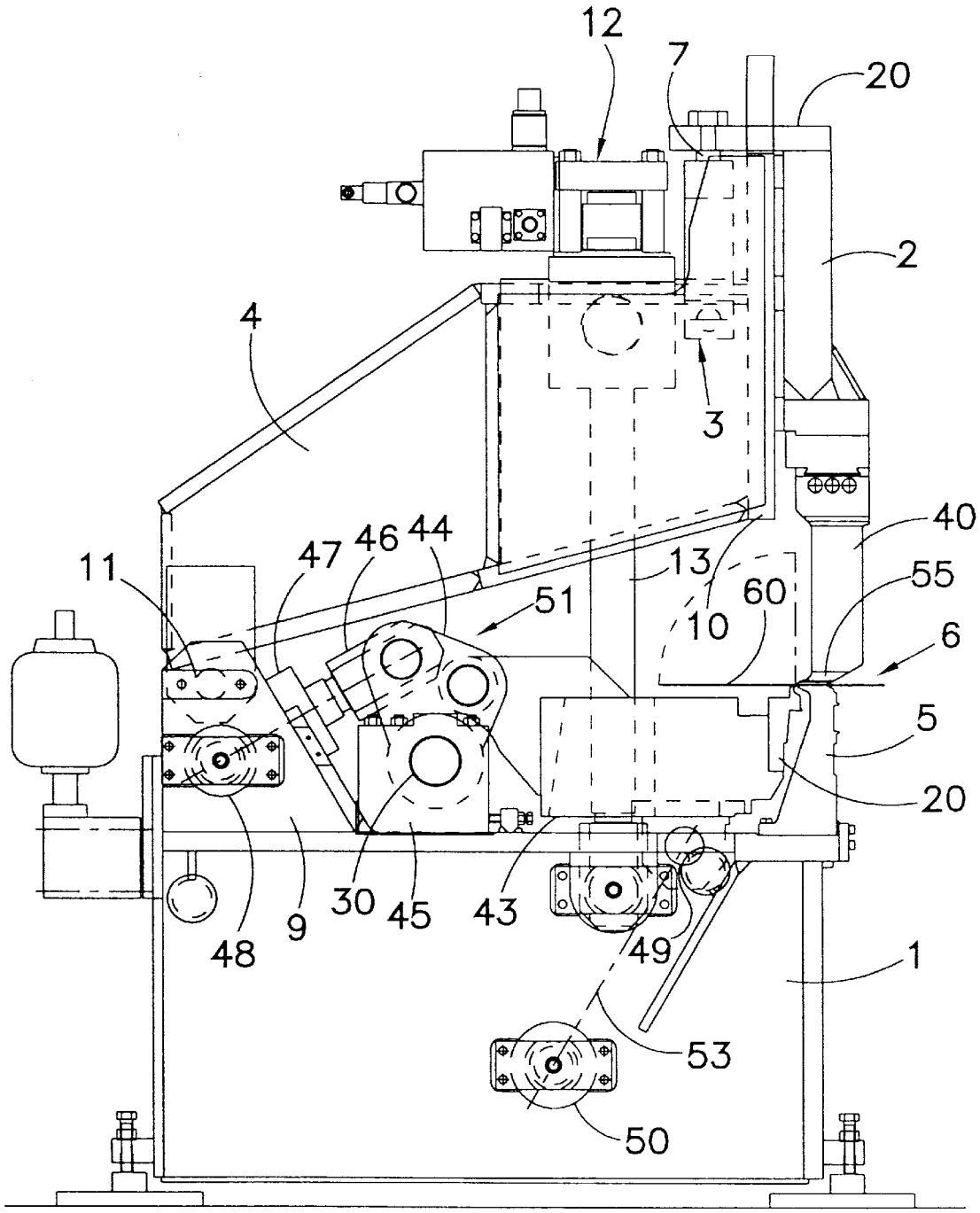
FIG. 2 is similar to FIG. 1 but with the blank holder foot lowered in order to allow the bending of the edge of a sheet metal panel.
Figure 3:
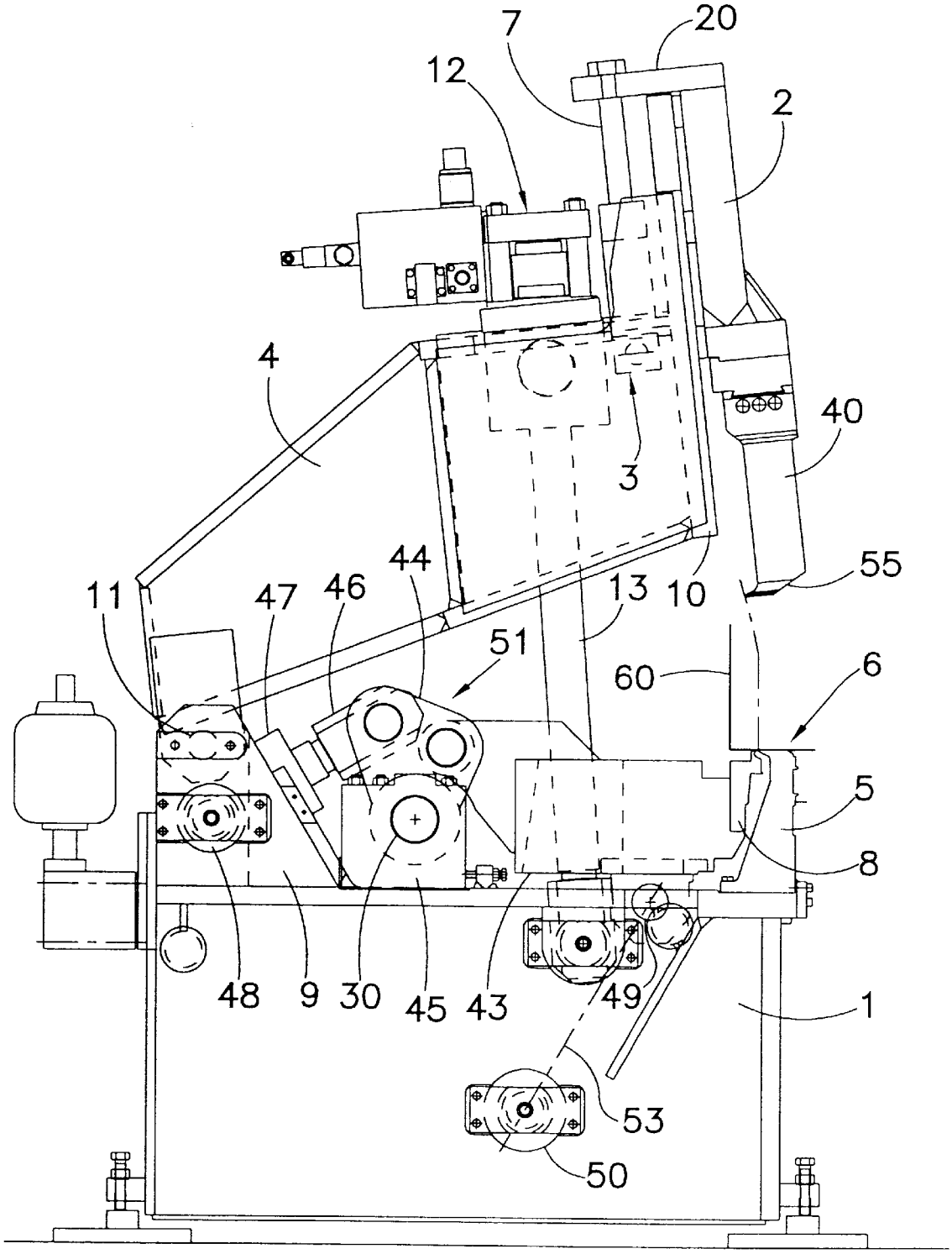
FIG. 3 is similar to FIG. 2 but with the blank holder foot lifted in order to allow the extraction of the sheet metal panel with folded edge.

The main advantage of the rectilinear vertical motion of the blank holder 40 is clearly observable in FIGS. 2 and 3.

FIG. 2 shows a bending machine with a blank holder 40 that is lowered in order to co-operate with the counter blade 5 so as to press a sheet metal panel 6, that is positioned in a such way that an edge of the same, indicated by 60, projects inside the space between the base 1 and the support 4.

In a following phase the blank holder 40 co-operates with the blade 8 in order to allow the latter to bend the edge 60 upward in such a way that it forms a substantially straight angle with the remaining part of the sheet metal panel 6. At this point the sole rotation of the turnable support 4 of the blank holder 40 around the axis 11 would not be enough to allow the bearing foot 55 to get far from the counter blade 5 without hitting the folded edge 60 of the sheet metal panel.

Owing to the cylinders 3 it is however possible to impose the blank holder 40 a previous vertical sliding upward, that allows then the blank holder 40 to follow the rotation of the support 4 without any damage for the sheet metal edge 60.

What is claimed is:

1. A bending machine for providing sheet metal panels with high edges, comprising:

a stationary base;

a counter blade that is fixedly mounted on the stationary base and defines a resting plane for a sheet metal panel;

a turnable support for a blank holder that has a rear part hinged to said stationary base and a front part;

a blank holder that is attached to a front face of said front part of said turnable support above said counter blade;

first moving means connected with said turnable support in order to rotate said turnable support with respect to said stationary base between a rest position in which said blank holder is spaced from said counter blade and a working position in which said blank holder is pressed against said counter blade with a sheet metal panel interposed therebetween; and at least one bending blade which is at least vertically movable with respect to said counter blade and said blank holder and is engageable therewith in order to bend a peripheral edge of a sheet metal panel at an angle of at least 900 with respect to the resting plane of the sheet metal panel, wherein said blank holder is connected with said turnable support in an upwardly and downwardly slidable manner with respect to said turnable support, and second moving means causing said blank holder to move upwardly with respect to said turnable support at an end of a bending operation in order to increase the space between said blank holder and said counter blade with respect to a spacing caused by rotation of said turnable support from the working position to the rest position thereby allowing extraction of the bent edge of the sheet metal panel from the bending machine.

2. Bending machine according to claim 1, characterized in that said blank holder is fixed to a slidable support that is capable to slide vertically on guides that are fixedly mounted to said turnable support and said second moving means comprise at least a hydraulic cylinder that is held by said turnable support.

3. Bending machine according to claim 2, characterized in that said slidable support is connected with a piston rod of said hydraulic cylinder by means of a perpendicular extension of its upper end.

4. Bending machine according to claim 3, characterized in that said cylinder is housed inside said turnable support and is parallel to the blank holder.

5. Bending machine according to claim 1, characterized in that said first moving means comprise a plurality of hydraulic cylinders and relative rods, the first ones of which are hinged to said turnable support and the second ones to the stationary base.

6. Bending machine according to claim 4, characterized in that said first moving means comprise a plurality of hydraulic cylinders and relative rods, the first ones of which are hinged to said turnable support and the second ones to the stationary base.

* * * * *

UNITED STATES PATENT AND TRADEMARK OFFICE

CERTIFICATE OF CORRECTION

PATENT NO. : 6,354,129 B1
DATED : March 12, 2002
INVENTOR(S) : Venturini

It is certified that error appears in the above-identified patent and that said Letters Patent is hereby corrected as shown below:

Column 3,
Line 32, replace “900” with -- 90º --.

Signed and Sealed this

Eighteenth Day of June, 2002

*Attest:*

*Attesting Officer*

JAMES E. ROGAN
*Director of the United States Patent and Trademark Office*